US011282630B2

(12) United States Patent
Yamaguchi et al.

(10) Patent No.: US 11,282,630 B2
(45) Date of Patent: Mar. 22, 2022

(54) COMMON MODE CHOKE COIL

(71) Applicant: Murata Manufacturing Co., Ltd., Kyoto-fu (JP)

(72) Inventors: Koichi Yamaguchi, Nagaokakyo (JP); Masashi Hattori, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 476 days.

(21) Appl. No.: 16/374,657

(22) Filed: Apr. 3, 2019

(65) Prior Publication Data

US 2019/0326047 A1 Oct. 24, 2019

(30) Foreign Application Priority Data

Apr. 18, 2018 (JP) ..... JP2018-080089

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/02* (2013.01); *H01F 27/292* (2013.01)

(58) Field of Classification Search
CPC ..... H01F 27/2804; H01F 27/02
(Continued)

(56) References Cited

U.S. PATENT DOCUMENTS 8,633,793 B1 * 1/2014 Chang ..... H01F 17/0013 336/200
8,653,928 B2 * 2/2014 Nogi ..... H01F 17/0013 336/200
(Continued)

FOREIGN PATENT DOCUMENTS

JP 2001-250723 A 9/2001
JP 2001-284125 A 10/2001
(Continued)

OTHER PUBLICATIONS

An Office Action; "Notification of Reasons for Refusal," mailed by the Japanese Patent Office dated Jul. 7, 2020, which corresponds to Japanese Patent Application No. 2018-080089 and is related to U.S. Appl. No. 16/374,657 with English language translation.
(Continued)

*Primary Examiner* — Ronald Hinson
(74) *Attorney, Agent, or Firm* — Studebaker & Brackett PC

(57) ABSTRACT

A common mode choke coil includes a body, a first spiral conductor, a second spiral conductor, a first extension conductor, and a second extension conductor. The thickness of the first extension conductor is equal to or less than (thickness of the first spiral conductor)/(winding number of the first spiral conductor), and the width of the first extension conductor is equal to or more than (width of the first spiral conductor)×(thickness of the first spiral conductor)/(thickness of the first extension conductor). The thickness of the second extension conductor is equal to or less than (thickness of the second spiral conductor)/(winding number of the second spiral conductor), and the width of the second extension conductor is equal to or more than (width of the second spiral conductor)×(thickness of the second spiral conductor)/(thickness of the second extension conductor).

20 Claims, 10 Drawing Sheets

(51) Int. Cl.
*H01F 27/02* (2006.01)
*H01F 27/29* (2006.01)

(58) Field of Classification Search
USPC ..... 336/200
See application file for complete search history.

(56) References Cited

U.S. PATENT DOCUMENTS

| | | | | |
|---|---|---|---|---|
| 9,251,953 | B2 * | 2/2016 | Chang | H01F 27/255 |
| 2011/0025442 | A1 * | 2/2011 | Hsieh | H01F 17/0013 336/200 |
| 2013/0222104 | A1 * | 8/2013 | Kitamura | H01F 41/046 336/200 |
| 2014/0125445 | A1 | 5/2014 | Sim et al. | |
| 2014/0191838 | A1 * | 7/2014 | Yoshida | H01F 27/2804 336/200 |
| 2014/0266547 | A1 | 9/2014 | Watanabe et al. | |
| 2016/0049234 | A1 * | 2/2016 | Kawashima | H01F 17/0013 336/200 |
| 2018/0130596 | A1 | 5/2018 | Yamaguchi | |

FOREIGN PATENT DOCUMENTS

| | | | |
|---|---|---|---|
| JP | 2009-176829 | A | 8/2009 |
| JP | 2009-212255 | A | 9/2009 |
| JP | 2014-096588 | A | 5/2014 |
| JP | 2014-179453 | A | 9/2014 |
| WO | 2014/171140 | A1 | 10/2014 |
| WO | 2017/018109 | A1 | 2/2017 |

OTHER PUBLICATIONS

An Office Action; "Notice of Reasons for Refusal," mailed by the Japanese Patent Office dated Jan. 26, 2021, which corresponds to Japanese Patent Application No. 2018-080089 and is related to U.S. Appl. No. 16/374,657 with English language translation.

* cited by examiner

COMMON MODE CHOKE COIL

CROSS-REFERENCE TO RELATED APPLICATION

This application claims benefit of priority to Japanese Patent Application No. 2018-080089, filed Apr. 18, 2018, the entire content of which is incorporated herein by reference.

BACKGROUND

Technical Field

The present disclosure relates to a common mode choke coil.

Background Art

An existing common mode choke coil is disclosed in WO2014/171140. The common mode choke coil includes a multilayer body, an upper, first coil conductor and a lower, second coil conductor that are formed in the multilayer body, a first extension conductor that is disposed above the first coil conductor in the multilayer body and that is connected to the first coil conductor, and a second extension conductor that is disposed below the second coil conductor in the multilayer body and that is connected to the second coil conductor. The first coil conductor is connected to a first outer electrode. The first extension conductor is connected to a second outer electrode. The second coil conductor is connected to a third outer electrode. The second extension conductor is connected to a fourth outer electrode.

SUMMARY

The existing common mode choke coil has a multilayer structure of the first coil conductor, the second coil conductor, the first extension conductor, and the second extension conductor, which increases the thickness of the whole of the layers and causes a problem in that flexibility is insufficient. In particular, from the perspective of electric resistance and a stacking process, the thickness of the first extension conductor and the second extension conductor is typically equal to the thickness of the first coil conductor and the second coil conductor.

Accordingly, the present disclosure provides a common mode choke coil that has increased flexibility.

According to preferred embodiments of the present disclosure, a common mode choke coil includes a body, and a first spiral conductor and a second spiral conductor that face each other inside the body and that are wound in respective planes. The common mode choke coil further includes a first outer electrode, a second outer electrode, a third outer electrode, and a fourth outer electrode that are disposed on the body, a first extension conductor that faces the first spiral conductor inside the body, that is on an opposite side of the first spiral conductor from the second spiral conductor, and that extends in a plane, and a second extension conductor that faces the second spiral conductor inside the body, that is on an opposite side of the second spiral conductor from the first spiral conductor, and that extends in a plane. An outer circumferential end of the first spiral conductor is electrically connected to the first outer electrode, a first end portion of the first extension conductor is electrically connected to an inner circumferential end of the first spiral conductor, and a second end portion of the first extension conductor is electrically connected to the second outer electrode. An outer circumferential end of the second spiral conductor is electrically connected to the third outer electrode, a first end portion of the second extension conductor is electrically connected to an inner circumferential end of the second spiral conductor, and a second end portion of the second extension conductor is electrically connected to the fourth outer electrode. A thickness of the first extension conductor is equal to or less than (a thickness of the first spiral conductor)/(a winding number of the first spiral conductor), and a width of the first extension conductor is equal to or more than (a width of the first spiral conductor)×(the thickness of the first spiral conductor)/(the thickness of the first extension conductor). A thickness of the second extension conductor is equal to or less than (a thickness of the second spiral conductor)/(a winding number of the second spiral conductor), and a width of the second extension conductor is equal to or more than (a width of the second spiral conductor)×(the thickness of the second spiral conductor)/(the thickness of the second extension conductor).

The width of the first spiral conductor is a length in the direction perpendicular to the direction in which the first spiral conductor extends in the plane in which the first spiral conductor is wound. The width of the first extension conductor is a length in the direction perpendicular to the direction in which the first extension conductor extends from the first end portion to the second end portion in the plane in which the first extension conductor extends. The same is true for the width of the second spiral conductor and the width of the second extension conductor. The thickness of the first and second spiral conductors and the first and second extension conductors is a length in the direction perpendicular to the width thereof in a cross section perpendicular to the direction in which each conductor extends. Note that (A)/(B) means a quotient obtained by dividing A by B, and that (C)×(D) means a product obtained by multiplying C by D.

According to the preferred embodiments of the present disclosure, the thickness of the first and second extension conductors is less than the thickness of the first and second spiral conductors, and the flexibility of the common mode choke coil increases.

In particular, the width of the first and second extension conductors increases depending on the degree at which the thickness of the first and second extension conductors decreases. Accordingly, the sectional area of the first and second extension conductors is not smaller than the sectional area of the first and second spiral conductors. Consequently, the resistance of current that flows through the first and second extension conductors can be equal to or less than the resistance of current that flows through the first and second spiral conductors, the flexibility increases, and characteristics are not degraded.

According to preferred embodiments of the present disclosure, the common mode choke coil includes a first terminal conductor that is connected between the first extension conductor and the second outer electrode inside the body and that extends in a plane, and a second terminal conductor that is connected between the second extension conductor and the fourth outer electrode inside the body and that extends in a plane. The first terminal conductor and the first spiral conductor are arranged in the same plane, and the second terminal conductor and the second spiral conductor are arranged in the same plane.

According to the preferred embodiments of the present disclosure, the first extension conductor is not directly connected to the second outer electrode but is connected thereto with the first terminal conductor interposed therebetween, and the occurrence of disconnection due to a bend of the substrate near the outer electrode can be reduced during mounting. Since the first terminal conductor is disposed in the same plane as in the first spiral conductor, the thickness of the common mode choke coil can be inhibited from increasing even when the first terminal conductor is provided.

Similarly, the second extension conductor is not directly connected to the fourth outer electrode but is connected thereto with the second terminal conductor interposed therebetween, and the occurrence of disconnection due to a bend of the substrate near the outer electrode can be reduced during mounting. Since the second terminal conductor is disposed in the same plane as in the second spiral conductor, the thickness of the common mode choke coil can be inhibited from increasing even when the second terminal conductor is provided.

According to preferred embodiments of the present disclosure, a thickness of the first terminal conductor is equal to the thickness of the first spiral conductor, and a thickness of the second terminal conductor is equal to the thickness of the second spiral conductor. According to the preferred embodiments of the present disclosure, the thickness of the common mode choke coil can be inhibited from increasing even when the first and second terminal conductors are provided.

According to preferred embodiments of the present disclosure, each of the first terminal conductor and the second terminal conductor has a hollow that extends therethrough in a thickness direction. According to the preferred embodiments of the present disclosure, since each of the first terminal conductor and the second terminal conductor has the hollow, the flexibility of the common mode choke coil further increases. According to preferred embodiments of the present disclosure, the hollow of the first terminal conductor is located such that a longitudinal direction thereof extends toward a center of the first spiral conductor, and the hollow of the second terminal conductor is located such that a longitudinal direction thereof extends toward a center of the second spiral conductor.

According to the preferred embodiments of the present disclosure, the flexibility in the direction intersecting the longitudinal direction of the hollow further increases.

According to preferred embodiments of the present disclosure, the body includes an insulator that covers the first spiral conductor, the second spiral conductor, the first extension conductor, and the second extension conductor, and a first magnetic material and a second magnetic material that interpose the insulator therebetween in a thickness direction. The insulator has a hollow that extends through a central portion of the first spiral conductor and a central portion of the second spiral conductor in the thickness direction. The first extension conductor and the second extension conductor do not overlap the hollow of the insulator in a top view.

According to the preferred embodiments of the present disclosure, since the insulator has the hollow, the flexibility of the common mode choke coil further increases. The first extension conductor and the second extension conductor do not overlap an inner, magnetic path on which magnetic flux is concentrated, and an eddy current loss, which is caused by blocking the magnetic flux, can be reduced. Since the hollow, which greatly deforms due to bending, and the extension conductors do not overlap, the extension conductors can be inhibited from being damaged due to bending.

According to preferred embodiments of the present disclosure, the body includes an insulating substrate that contains glass cloth between the first spiral conductor and the second spiral conductor. According to the preferred embodiments of the present disclosure, since the insulating substrate that contains glass cloth is disposed between the first spiral conductor and the second spiral conductor, insulation properties between the first spiral conductor and the second spiral conductor are improved, and strength against bending increases.

According to preferred embodiments of the present disclosure, the common mode choke coil has increased flexibility.

Other features, elements, characteristics and advantages of the present disclosure will become more apparent from the following detailed description of embodiments of the present disclosure with reference to the attached drawings.

DETAILED DESCRIPTION

Embodiments according to the present disclosure will hereinafter be described in detail with reference to the drawings.

First Embodiment

Structure

Figure 1:
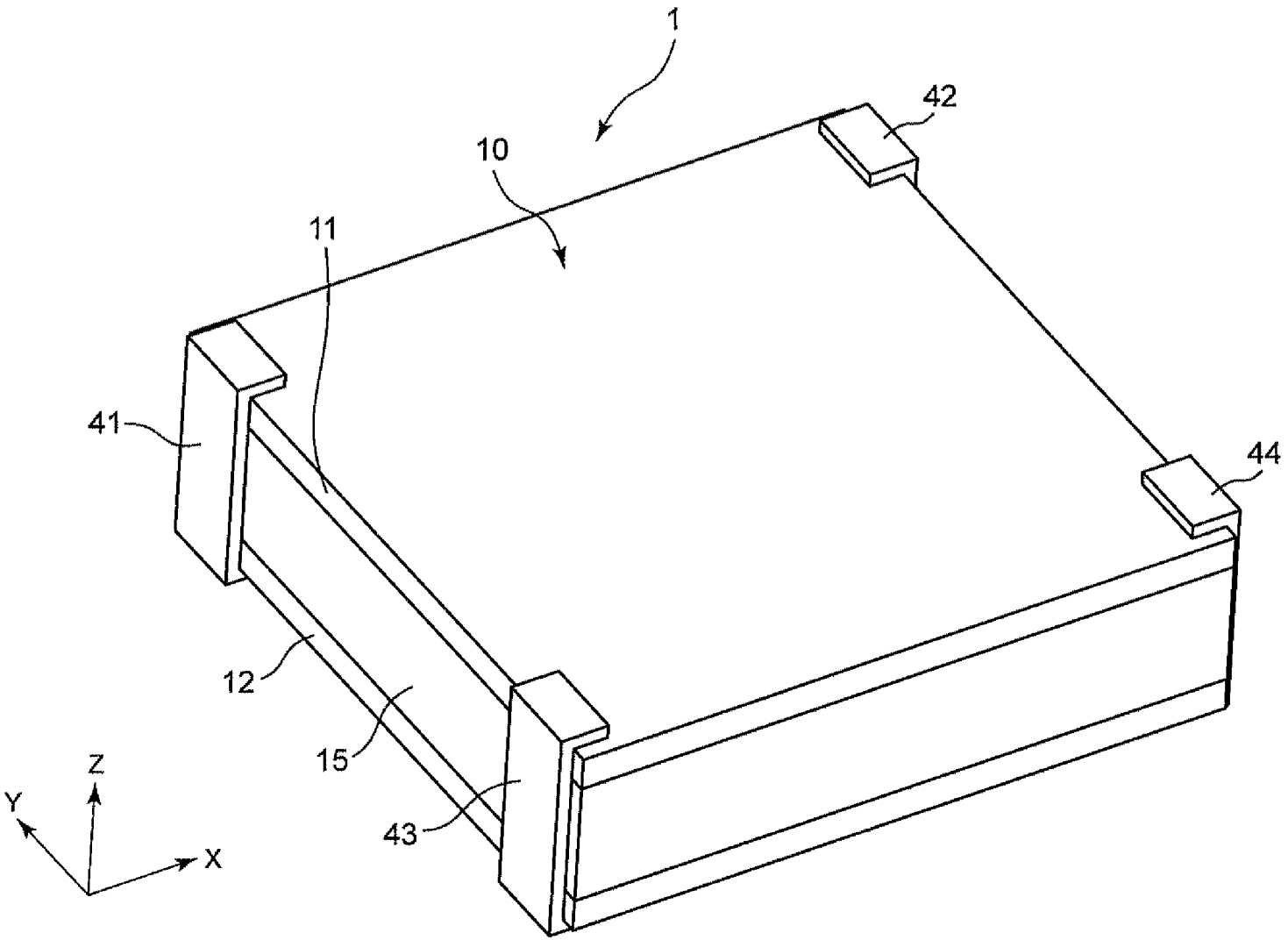
FIG. 1 is a perspective view of a common mode choke coil according to a first embodiment.
Figure 2:
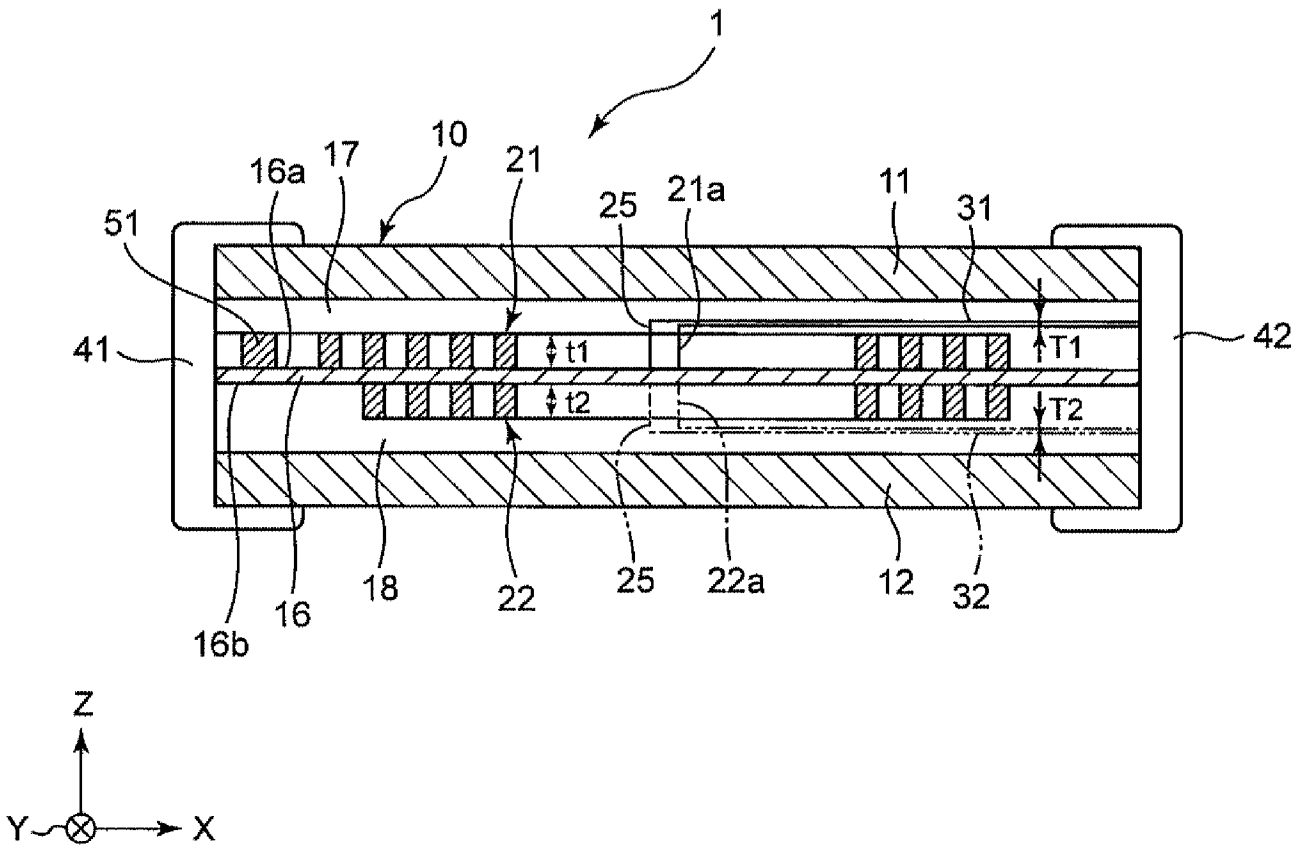
FIG. 2 is a perspective sectional view of the common mode choke coil taken along an XZ section.
Figure 3A:
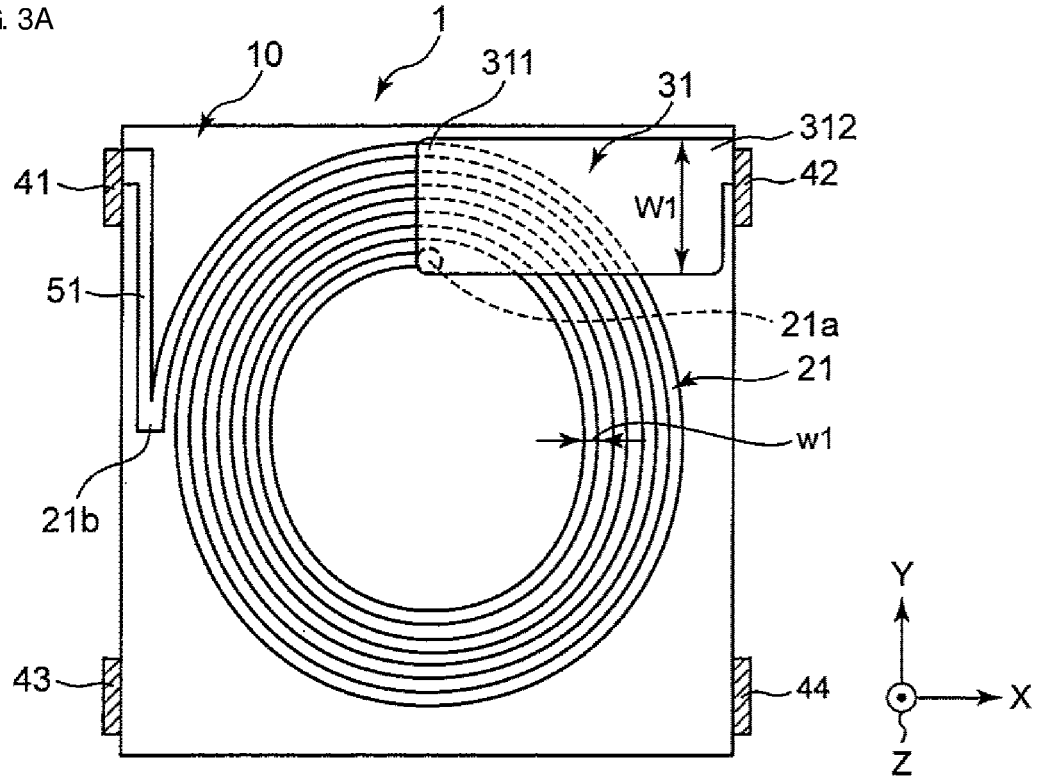
FIG. 3A schematically illustrates the common mode choke coil along an XY plane.
Figure 3B:
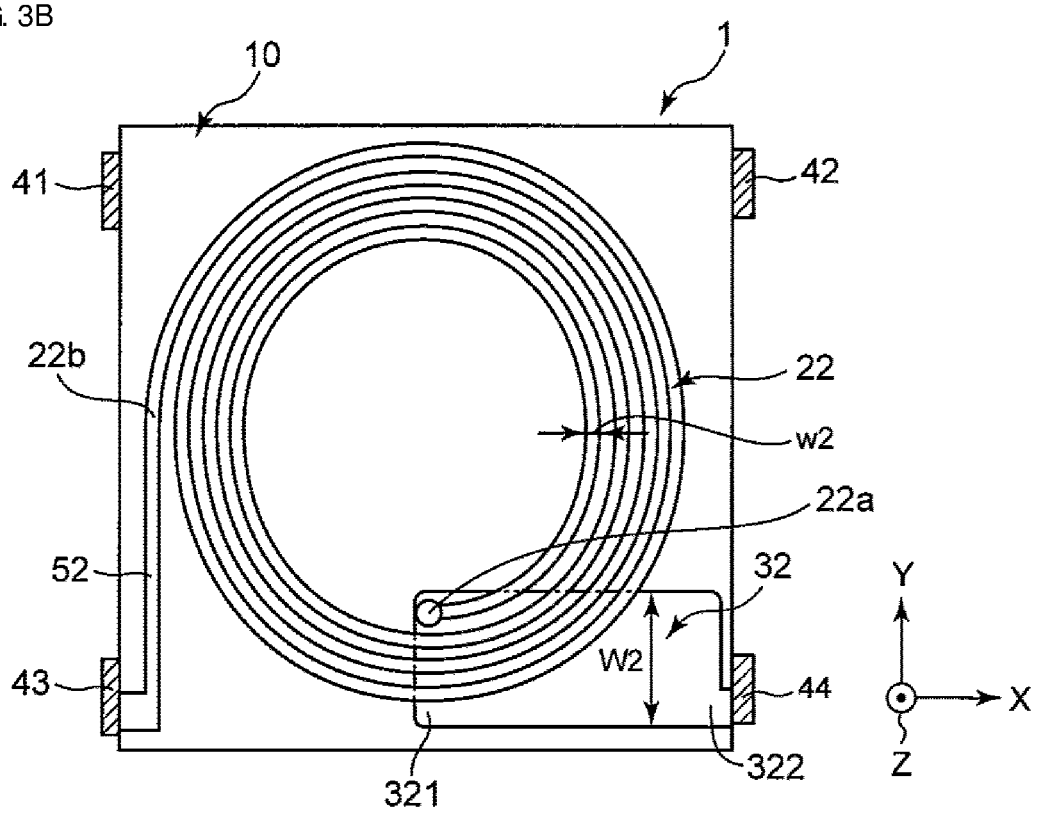
FIG. 3B schematically illustrates the common mode choke coil along an XY plane.

FIG. 1 is a perspective view of a common mode choke coil according to a first embodiment. FIG. 2 schematically illustrates the common mode choke coil in FIG. 1 along an XZ section. FIG. 3A and FIG. 3B schematically illustrate the common mode choke coil in FIG. 1 along different XY planes.

A common mode choke coil 1 is a component that is installed in an electronic device such as a personal computer, a DVD player, a digital camera, a TV, a cellular phone, or a car electronics and that has, for example, a substantially rectangular cuboid shape overall. The shape of the common mode choke coil 1, however, is not particularly limited and may be a substantially columnar shape, a substantially polygonal column shape, a substantially truncated cone shape, or a substantially polygonal frustum shape.

As illustrated in FIG. 1, FIG. 2, FIG. 3A, and FIG. 3B, the common mode choke coil 1 includes a body 10 obtained by staking layers, a first spiral conductor 21 and a second spiral conductor 22 that are disposed inside the body 10, a first outer electrode 41, a second outer electrode 42, a third outer electrode 43, and a fourth outer electrode 44 that are disposed on the body 10, and a first extension conductor 31 and a second extension conductor 32 that are disposed inside the body 10. In the figures, the thickness direction (stacking direction) of the common mode choke coil 1 is referred to as the Z-direction, the positive Z-direction means an upward direction, and the negative Z-direction means a downward direction. In a plane perpendicular to the Z-direction of the common mode choke coil 1, the direction of a side of a quadrilateral is referred to as the X-direction, the direction of another side of the quadrilateral is referred to as the Y-direction. In FIG. 2, the second extension conductor 32 is illustrated by an imaginary line.

The body 10 includes an insulator 15 that covers the first spiral conductor 21, the second spiral conductor 22, the first extension conductor 31, and the second extension conductor 32, and an upper, first magnetic material 11 and a lower, second magnetic material 12 that interpose the insulator 15 therebetween in the thickness direction.

The insulator 15 includes a flat-plate-shaped insulating substrate 16 main surfaces of which are quadrilateral, and an upper, first insulating layer 17 and a lower, second insulating layer 18 that interpose the insulating substrate 16 therebetween. The insulating substrate 16 is composed of an insulating material and contains, for example, glass cloth. For example, the insulating substrate 16 may be a flexible insulating resin film or composite resin film, examples of which include a glass epoxy resin film, a polyimide film, or a polyethylene naphthalate film. The first insulating layer 17 and the second insulating layer 18 are composed of a resin material such as an epoxy resin, a phenolic resin, or a polyimide resin or an inorganic material such as a silicon or aluminum oxide film or a nitride film.

The first magnetic material 11 and the second magnetic material 12 are composed of a layer of a magnetic material, examples of which include a resin containing magnetic material powder. Examples of the resin of which the first magnetic material 11 and the second magnetic material 12 are composed include an epoxy resin, a phenolic resin, and a polyimide resin. Examples of the magnetic material powder include powder of a magnetic metal material, examples of which include an FeSi alloy such as FeSiCr, an FeCo alloy, an Fe alloy such as NiFe, powder of an amorphous alloy thereof, and ferrite powder.

The first spiral conductor 21 and the second spiral conductor 22 face each other in the Z-direction inside the body 10 and are wound in respective planes. The insulating substrate 16 is disposed between the first spiral conductor 21 and the second spiral conductor 22. The first spiral conductor 21 is formed on the upper, first main surface 16*a* of the insulating substrate 16. The second spiral conductor 22 is formed on the lower, second main surface 16*b* of the insulating substrate 16. The first spiral conductor 21 and the second spiral conductor 22 are concentrically arranged. The first spiral conductor 21 is covered by the first insulating layer 17. The second spiral conductor 22 is covered by the second insulating layer 18.

Each of the first spiral conductor 21 and the second spiral conductor 22 has a substantially spiral shape, and the winding number thereof is more than one. That is, the substantially spiral shape is a shape that has a winding number of more than one. The first spiral conductor 21 is spirally wound in the clockwise direction from an outer circumferential end 21*b* to an inner circumferential end 21*a* when viewed from above. The second spiral conductor 22 is spirally wound in the clockwise direction from an outer circumferential end 22*b* to an inner circumferential end 22*a* when viewed from above.

It is preferable that the thickness of the first and second spiral conductors 21 and 22 be more than the thickness of the insulating substrate 16, for example, no less than 40 μm and no more than 120 μm. According to an embodiment, the thickness of the first and second spiral conductors 21 and 22 is about 45 μm, the wire width thereof is about 40 μm, and the space between wires thereof is about 10 μm. The space between wires is preferably no less than 3 μm and no more than 20 μm. The first and second spiral conductors 21 and 22 are composed of a conductive material, examples of which include a metal material having a low electric resistance such as Cu, Ag, or Au. According to the present embodiment, the winding number of the first spiral conductor 21 is about 4.25 turns, and the winding number of the second spiral conductor 22 is about 3.75 turns.

The first to fourth outer electrodes 41 to 44 are formed on surfaces of the body 10. The first to fourth outer electrodes 41 to 44 are disposed near the corners of the body 10. The first outer electrode 41 and the second outer electrode 42 face each other in the X-direction. The first outer electrode 41 and the third outer electrode 43 are arranged in the Y-direction along one of the surfaces of the body 10. The third outer electrode 43 and the fourth outer electrode 44 face each other in the X-direction. The second outer electrode 42 and the fourth outer electrode 44 are arranged in the Y-direction along another surface of the body 10. The first to fourth outer electrodes 41 to 44 extend from the lower surface to the upper surface of the body 10 across the corresponding side surfaces of the body 10 and have a substantially U-shape.

The first to fourth outer electrodes 41 to 44 are composed of a conductive material and has, for example, a three-layer structure of Cu, Ni, and Au that are arranged in this order from the inside to the outside, where Cu has a low electric resistance and a high stress resistance, Ni has a high corrosion resistance, and Au has high wettability and high reliability. The first to fourth outer electrodes 41 to 44 are preferably subjected to a rustproofing process. The rustproofing process is a process of forming, for example, a film of Ni and Au or a film of Ni and Sn. This enables copper leaching due to solder, and rust to be inhibited from occurring and enables the common mode choke coil 1 to have high mounting reliability.

The first extension conductor 31 faces the first spiral conductor 21 and is on the opposite side of (above) the first spiral conductor 21 from the second spiral conductor 22. The first extension conductor 31 extends in a plane. The first extension conductor 31 overlaps a region from the inner circumferential surface to the outer circumferential surface of the first spiral conductor 21 and does not overlap a central portion of the first spiral conductor 21. The first extension conductor 31 is, but not limited to, substantially quadrilateral in a plan view.

The outer circumferential end 21*b* of the first spiral conductor 21 is electrically connected to the first outer electrode 41. The outer circumferential end 21*b* is connected to the first outer electrode 41 with a first extension conductor 51 in the same layer as in the first spiral conductor 21 interposed therebetween. The outer circumferential end 21*b* may be directly connected to the first outer electrode 41.

A first end portion 311 of the first extension conductor 31 is electrically connected to the inner circumferential end 21*a* of the first spiral conductor 21. The first end portion 311 is connected to the inner circumferential end 21*a* with a corresponding one of columnar conductors 25 that extend in the Z-direction interposed therebetween. The wire width of the columnar conductor 25 is equal to the wire width of the first spiral conductor 21 but may be less than the wire width of the first spiral conductor 21.

A second end portion 312 of the first extension conductor 31 is electrically connected to the second outer electrode 42. The second end portion 312 is directly connected to the second outer electrode 42. The second end portion 312 may be connected to the second outer electrode 42 with another conductor interposed therebetween. Consequently, the first outer electrode 41 and the second outer electrode 42 are an input terminal and an output terminal of the first spiral conductor 21.

The second extension conductor 32 faces the second spiral conductor 22 and is on the opposite side of (below) the second spiral conductor 22 from the first spiral conductor 21. The second extension conductor 32 extends in a plane. The second extension conductor 32 overlaps a region from the inner circumferential surface to the outer circumferential surface of the second spiral conductor 22 and does not overlap a central portion of the second spiral conductor 22. The second extension conductor 32 is, but not limited to, substantially quadrilateral in a plan view.

The outer circumferential end 22*b* of the second spiral conductor 22 is electrically connected to the third outer electrode 43. The outer circumferential end 22*b* is connected to the third outer electrode 43 with a second extension conductor 52 in the same layer as in the second spiral conductor 22 interposed therebetween. The outer circumferential end 22*b* may be directly connected to the third outer electrode 43.

A first end portion 321 of the second extension conductor 32 is electrically connected to the inner circumferential end 22*a* of the second spiral conductor 22. The first end portion 321 is connected to the inner circumferential end 22*a* with the corresponding columnar conductor 25 that extends in the Z-direction interposed therebetween. The wire width of the columnar conductor 25 is equal to the wire width of the second spiral conductor 22 but may be less than the wire width of the second spiral conductor 22.

A second end portion 322 of the second extension conductor 32 is electrically connected to the fourth outer electrode 44. The second end portion 322 is directly connected to the fourth outer electrode 44. The second end portion 322 may be connected to the fourth outer electrode 44 with another conductor interposed therebetween.

Consequently, the third outer electrode 43 and the fourth outer electrode 44 are an input terminal and an output terminal of the second spiral conductor 22. The first and second extension conductors 31 and 32 are composed of a conductive material, examples of which include a metal material having a low electric resistance such as Cu, Ag, or Au.

The thickness T1 of the first extension conductor 31 is equal to or less than (the thickness t1 of the first spiral conductor 21)/(the winding number of the first spiral conductor 21). The width W1 of the first extension conductor 31 is equal to or more than (the width w1 of the first spiral conductor 21)×(the thickness t1 of the first spiral conductor 21)/(the thickness T1 of the first extension conductor 31).

The width w1 of the first spiral conductor 21 is a length in the direction perpendicular to the direction in which the first spiral conductor 21 extends in the plane in which the first spiral conductor 21 is wound. The width W1 of the first extension conductor 31 is a length in the direction perpendicular to the direction in which the first extension conductor 31 extends from the first end portion 311 to the second end portion 312 in the plane in which the first extension conductor 31 extends. More specifically, the direction perpendicular to the direction in which the first extension conductor 31 extends is the direction perpendicular to a current path, that is, the direction perpendicular to the direction of the minimum route from a contact between the first extension conductor 31 and the corresponding columnar conductor 25 to a contact between the first extension conductor 31 and the second outer electrode 42. The thickness of the first spiral conductor 21 and the first extension conductor 31 is a length in the direction perpendicular to the width thereof in a cross section perpendicular to the direction in which each conductor extends.

The thickness T2 of the second extension conductor 32 is equal to or less than (the thickness t2 of the second spiral conductor 22)/(the winding number of the second spiral conductor 22). The width W2 of the second extension conductor 32 is equal to or more than (the width w2 of the second spiral conductor 22)×(the thickness t2 of the second spiral conductor 22)/(the thickness T2 of the second extension conductor 32).

The width w2 of the second spiral conductor 22 is a length in the direction perpendicular to the direction in which the second spiral conductor 22 extends in the plane in which the second spiral conductor 22 is wound. The width W2 of the second extension conductor 32 is a length in the direction perpendicular to the direction in which the second extension conductor 32 extends from the first end portion 321 to the second end portion 322 in the plane in which the second extension conductor 32 extends. More specifically, the direction perpendicular to the direction in which the second extension conductor 32 extends is the direction perpendicular to a current path, that is, the direction perpendicular to the direction of the minimum route from a contact between the second extension conductor 32 and the corresponding columnar conductor 25 to a contact between the second extension conductor 32 and the fourth outer electrode 44. The thickness of the second spiral conductor 22 and the second extension conductor 32 is a length in the direction perpendicular to the width thereof in a cross section perpendicular to the direction in which each conductor extends.

In the common mode choke coil 1, the thicknesses T1 and T2 of the first and second extension conductors 31 and 32 satisfy the above relationship, and the winding number of the first and second spiral conductors 21 and 22 is 1 or more. Accordingly, the thicknesses T1 and T2 are less than the thicknesses t1 and t2 of the first and second spiral conductors 21 and 22, and the flexibility of the common mode choke coil 1 increases.

The widths W1 and W2 of the first and second extension conductors 31 and 32 satisfy the above relationship. Accordingly, the widths W1 and W2 of the first and second extension conductors 31 and 32 increase depending on the degree at which the thicknesses T1 and T2 of the first and second extension conductors 31 and 32 decrease. Accordingly, the sectional areas (the thickness T1×the width W1, and the thickness T2×the width W2) of the first and second extension conductors 31 and 32 are equal to or larger than the sectional areas of the first and second spiral conductors 21 and 22. Consequently, the resistance of current that flows through the first and second extension conductors 31 and 32 can be equal to or less than the resistance of current that flows through the first and second spiral conductors 21 and 22, the flexibility increases, and characteristics are not degraded.

Since the insulating substrate 16 is disposed between the first spiral conductor 21 and the second spiral conductor 22, insulation properties between the first spiral conductor 21 and the second spiral conductor 22 are improved, and strength against bending increases.

According to the above embodiment, the thickness of the first spiral conductor is equal to the thickness of the second spiral conductor, and the width of the first spiral conductor is equal to the width of the second spiral conductor. The thickness of the first extension conductor is equal to the thickness of the second extension conductor, and the width of the first extension conductor is equal to the width of the second extension conductor. The thickness and width of the first spiral conductor may differ from those of the second spiral conductor. The thickness and width of the first extension conductor may differ from those of the second extension conductor. The present embodiment satisfies the relationship: extension conductor width=spiral conductor width×winding number+line-to-line pitch×(winding number−1).

According to the above embodiment, the body includes the insulator and the magnetic materials. However, the body may include either the insulator or the magnetic materials. The body includes the insulating substrate. However, the body may not include the insulating substrate.

Manufacturing Method

A method according to an embodiment for manufacturing the common mode choke coil 1 will now be described.

A printed circuit board obtained by plating both surfaces of a very thin glass epoxy substrate overall with copper is etched to form spiral conductors (the first and second spiral conductors 21 and 22) on both surfaces of the substrate (the insulating substrate 16). Molded resin sheets (parts of first and second insulating layers 17 and 18) having a flat plate shape are disposed on both of the surfaces of the substrate. A molding process is performed on both of the surfaces of the substrate by heating and pressing.

Holes are drilled by laser drilling such that the holes reach the inner circumferential ends of the formed spiral conductors from the surfaces of the substrate subjected to the molding process to form cavities. A molded body after drilling is subjected to electroless positive electrolyte copper plating to fill the cavities from the inner circumferential ends of the spiral conductors so that conductors (the columnar conductors 25) that extend to the surfaces of the molded resin are formed.

Subsequently, for example, a dry film resist is applied to a surface of the molded body that is plated overall. A patterning process is performed, an etching process is performed with ferric chloride, and the residual dry film resist is separated. In this way, the extension conductors (the first and second extension conductors 31 and 32) connected to the inner circumferential ends of the spiral conductors are formed.

The extension conductors are connected to the inner circumferential ends of the spiral conductors and extend toward the outer circumference of the spiral conductors. The thickness of each extension conductor is equal to or less than (the thickness of the corresponding spiral conductor)/(the winding number of the spiral conductor). The width of each extension conductor is equal to or more than (the width of the corresponding spiral conductor)×(the thickness of the spiral conductor)/(the thickness of the extension conductor). Subsequently, molded resin sheets (parts of the first and second insulating layers 17 and 18) are attached again before magnetic sheets are attached.

Anisotropic composite magnetic sheets (the first and second magnetic materials 11 and 12) are formed by dispersing soft magnetic metal powder having an oblong shape in a resin material such that the longitudinal direction of the soft magnetic metal powder coincides with the in-plane direction of each sheet. Finally, the anisotropic composite magnetic sheets are directly bonded to the upper surface and lower surface of the molded body. Each magnetic sheet has heat resistance sufficient for reflow soldering. A very thin adhesive layer is formed on a surface of the magnetic sheet. The adhesive layer also has heat resistance sufficient for reflow soldering. The outer electrodes are disposed at the four corners of each magnetic sheet so as to be connected to surfaces of the corresponding extension conductors that are exposed from the insulator.

The shape of the common mode choke coil 1 according to an embodiment will be described. The insulating substrate has a substantially rectangular shape having dimensions of, for example, 5 mm×5 mm or more and 20 mm×20 mm or less (i.e., from 5 mm×5 mm to 20 mm×20 mm). The thickness of the insulating substrate is no less than 10 μm and no more than 100 μm (i.e., from 10 μm to 100 μm), preferably no less than 40 μm and no more than 70 μm (i.e., from 40 μm to 70 μm). The thickness of the common mode choke coil is no less than 300 μm and no more than 500 μm (i.e., from 300 μm to 500 μm), preferably no less than 350 μm and no more than 450 μm (i.e., from 350 μm to 450 μm).

Second Embodiment

Figure 4:
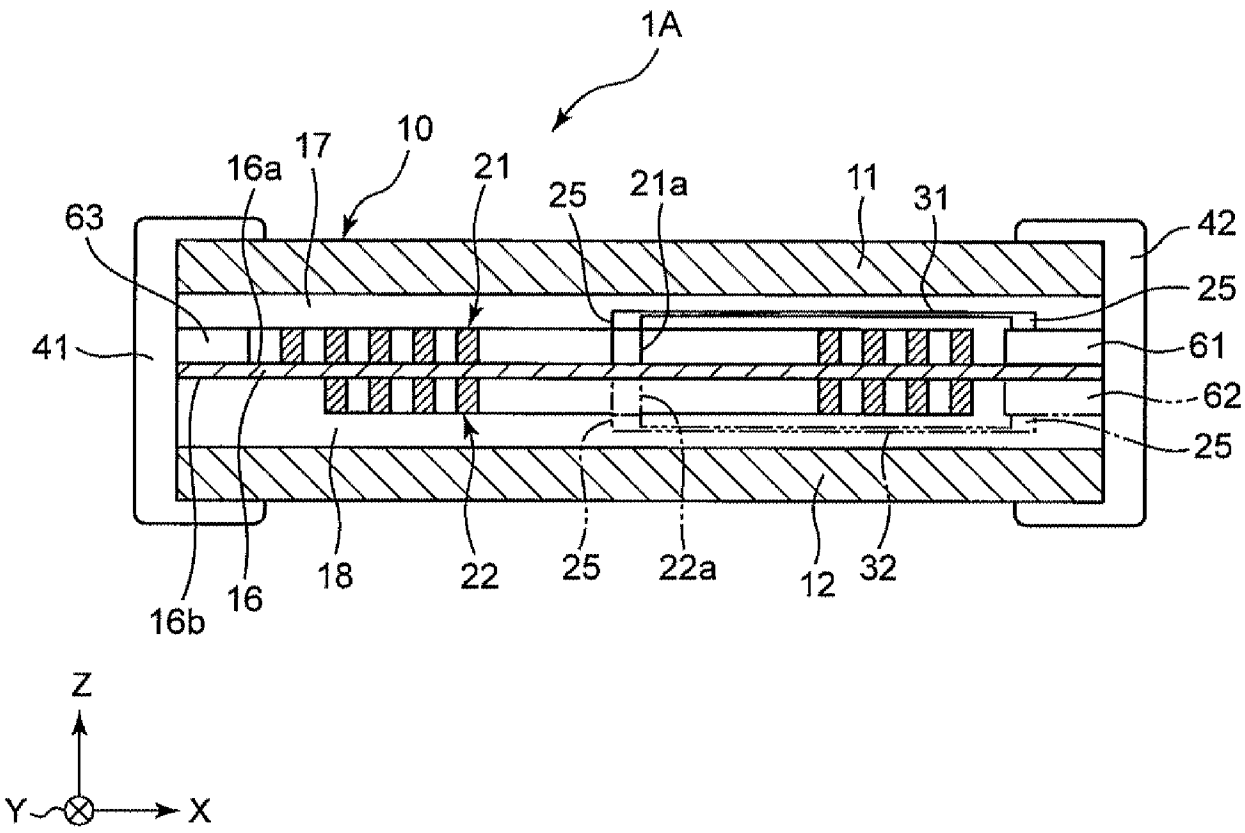
FIG. 4 is a perspective sectional view of a common mode choke coil according to a second embodiment taken along an XZ section.
Figure 5A:
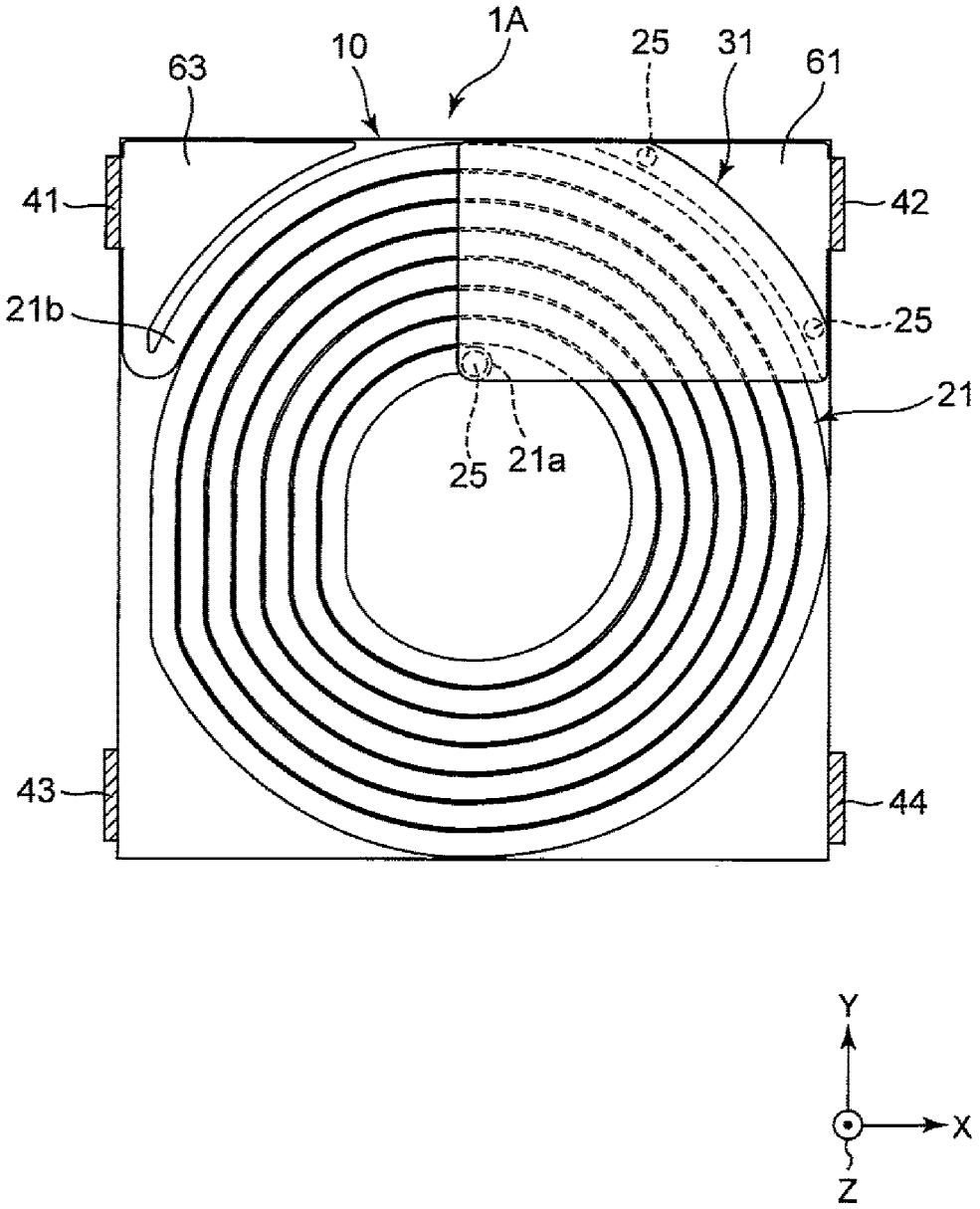
FIG. 5A schematically illustrates the common mode choke coil along an XY plane.
Figure 5B:
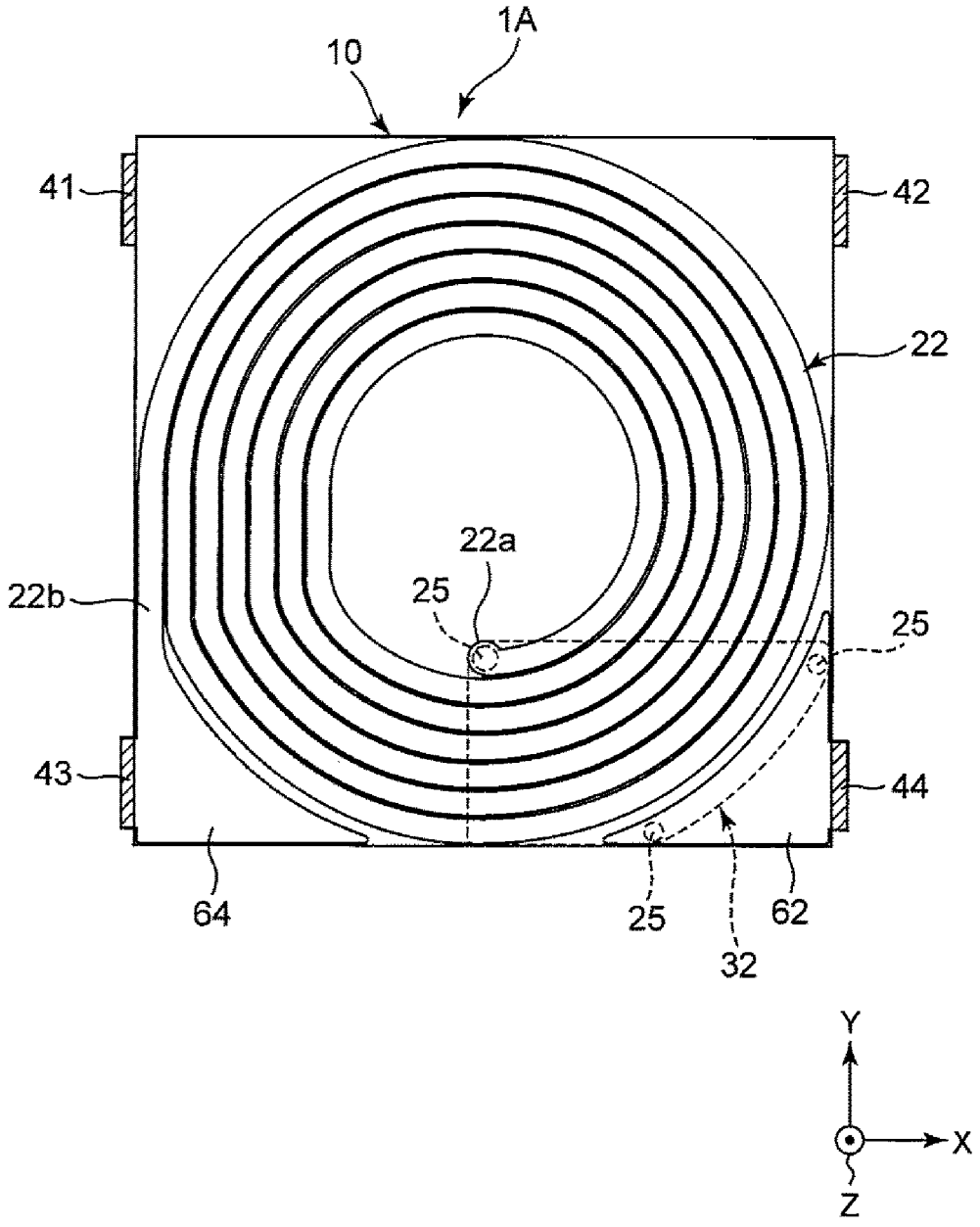
FIG. 5B schematically illustrates the common mode choke coil along an XY plane.

FIG. 4 schematically illustrates a common mode choke coil according to a second embodiment along an XZ section. FIG. 5A and FIG. 5B schematically illustrate the common mode choke coil along different XY planes. The second embodiment differs from the first embodiment in that terminal conductors are added. The different components will now be described. The other components are the same as those in the first embodiment and are designated by reference numbers like to those in the first embodiment, and a description thereof is omitted.

As illustrated in FIG. 4, FIG. 5A, and FIG. 5B, a common mode choke coil 1A according to the second embodiment includes a first terminal conductor 61 and a second terminal conductor 62 that extend in different XY planes inside the body 10 in addition to the components of the common mode choke coil 1 according to the first embodiment.

The first terminal conductor 61 is connected between the first extension conductor 31 and the second outer electrode 42. The first terminal conductor 61 is connected to the first extension conductor 31 with the corresponding columnar conductors 25 interposed therebetween. The first terminal conductor 61 is disposed in the same plane as in the first spiral conductor 21. The first terminal conductor 61 is disposed along the outer circumference of the first spiral conductor 21 and edge faces of the insulating substrate 16 and has a substantially triangle shape. The first terminal conductor 61 is disposed at the corner of the body 10 near the second outer electrode 42. For example, the first terminal conductor 61 and the first spiral conductor 21 are formed at the same time.

A part of the first terminal conductor 61 overlaps a part of the first extension conductor 31 when viewed in the Z-direction. The part of the first terminal conductor 61 and the part of the first extension conductor 31 that overlap are connected to each other with the corresponding columnar conductors 25 interposed therebetween. The first terminal conductor 61 and the second outer electrode 42 are in contact with each other along a YZ plane in the Z-direction. This makes the area of contact larger than that in the case where the first terminal conductor 61 and the second outer electrode 42 are in contact with each other along an XY plane.

Consequently, the first extension conductor 31 is not directly connected to the second outer electrode 42 but is connected thereto with the first terminal conductor 61 interposed therebetween, and the occurrence of disconnection due to a bend of the substrate near the outer electrode can be reduced during mounting. That is, since the first terminal conductor 61 and the second outer electrode 42 are in contact with each other along the YZ plane, the area of contact can be increased, and the strength of the contact between the first terminal conductor 61 and the second outer electrode 42 can be increased. The shape of the first terminal conductor 61 differs from the shape of the first extension conductor 31, and the magnitude of stress applied due to bending differs therebetween. Specifically, the first terminal conductor 61 is unlikely to bend, and the magnitude of the stress is small. Accordingly, the strength of the contact between the first terminal conductor 61 and the first extension conductor 31 is increased.

Since the first terminal conductor 61 is disposed in the same plane as in the first spiral conductor 21, the thickness of the common mode choke coil 1A can be inhibited from increasing even when the first terminal conductor 61 is provided. The thickness of the first terminal conductor 61 is preferably equal to the thickness of the first spiral conductor 21. In this case, the thickness of the common mode choke coil 1A can be inhibited from increasing even when the first terminal conductor 61 is provided. The thickness of the first terminal conductor 61 may be increased such that the first terminal conductor 61 is directly connected to the first extension conductor 31.

Similarly, the second terminal conductor 62 is connected between the second extension conductor 32 and the fourth outer electrode 44. The second terminal conductor 62 is connected to the second extension conductor 32 with the corresponding columnar conductors 25 interposed therebetween. The second terminal conductor 62 is disposed in the same plane as in the second spiral conductor 22. The second terminal conductor 62 is disposed along the outer circumference of the second spiral conductor 22 and edge faces of the insulating substrate 16 and has a substantially triangle shape. The second terminal conductor 62 is disposed at the corner of the body 10 near the fourth outer electrode 44. For example, the second terminal conductor 62 and the second spiral conductor 22 are formed at the same time.

A part of the second terminal conductor 62 overlaps a part of the second extension conductor 32 when viewed in the Z-direction. The part of the second terminal conductor 62 and the part of the second extension conductor 32 that overlap are connected to each other with the corresponding columnar conductors 25 interposed therebetween. The second terminal conductor 62 and the fourth outer electrode 44 are in contact with each other along a YZ plane in the Z-direction. This makes the area of contact larger than that in the case where the second terminal conductor 62 and the fourth outer electrode 44 are in contact with each other along an XY plane.

Consequently, the second extension conductor 32 is not directly connected to the fourth outer electrode 44 but is connected thereto with the second terminal conductor 62 interposed therebetween, and the occurrence of disconnection due to a bend of the substrate near the outer electrode can be reduced during mounting. That is, since the second terminal conductor 62 and the fourth outer electrode 44 are in contact with each other along the YZ plane, the area of contact can be increased, and the strength of the contact between the second terminal conductor 62 and the fourth outer electrode 44 can be increased. The shape of the second terminal conductor 62 differs from the shape of the second extension conductor 32, and the magnitude of stress applied due to bending differs therebetween. Specifically, the second terminal conductor 62 is unlikely to bend, and the magnitude of the stress is small. Accordingly, the strength of the contact between the second terminal conductor 62 and the second extension conductor 32 is increased.

Since the second terminal conductor 62 is disposed in the same plane as in the second spiral conductor 22, the thickness of the common mode choke coil 1A can be inhibited from increasing even when the second terminal conductor 62 is provided. The thickness of the second terminal conductor 62 is preferably equal to the thickness of the second spiral conductor 22. In this case, the thickness of the common mode choke coil 1A can be inhibited from increasing even when the second terminal conductor 62 is provided. The thickness of the second terminal conductor 62 may be increased such that the second terminal conductor 62 is directly connected to the second extension conductor 32.

The common mode choke coil 1A includes a third terminal conductor 63 instead of the first extension conductor 51 of the common mode choke coil 1 according to the first embodiment. The third terminal conductor 63 is connected between the first spiral conductor 21 and the first outer electrode 41. The third terminal conductor 63 is disposed in the same plane as in the first spiral conductor 21. The third terminal conductor 63 is disposed along the outer circumference of the first spiral conductor 21 and edge faces of the insulating substrate 16 and has a substantially triangle shape. The third terminal conductor 63 is disposed at the corner of the body 10 near the first outer electrode 41. For example, the third terminal conductor 63 and the first spiral conductor 21 are formed at the same time. The third terminal conductor 63 and the first outer electrode 41 are in contact with each other along a YZ plane in the Z-direction. This makes the area of contact larger than that in the case where the third terminal conductor 63 and the first outer electrode 41 are in contact with each other along an XY plane.

This increases the strength of the contact between the third terminal conductor 63 and the first outer electrode 41 and inhibits the thickness of the common mode choke coil 1A from increasing even when the third terminal conductor 63 is provided. The thickness of the third terminal conductor 63 is preferably equal to the thickness of the first spiral conductor 21. In this case, the thickness of the common mode choke coil 1A can be inhibited from increasing even when the third terminal conductor 63 is provided.

Similarly, the common mode choke coil 1A includes a fourth terminal conductor 64 instead of the second extension conductor 52 of the common mode choke coil 1 according to the first embodiment. The fourth terminal conductor 64 is connected between the second spiral conductor 22 and the third outer electrode 43. The fourth terminal conductor 64 is disposed in the same plane as in the second spiral conductor 22. The fourth terminal conductor 64 is disposed along the outer circumference of the second spiral conductor 22 and edge faces of the insulating substrate 16 and has a substantially triangle shape. The fourth terminal conductor 64 is disposed at the corner of the body 10 near the third outer electrode 43. For example, the fourth terminal conductor 64 and the second spiral conductor 22 are formed at the same time. The fourth terminal conductor 64 and the third outer electrode 43 are in contact with each other along a YZ plane in the Z-direction. This makes the area of contact larger than that in the case where the fourth terminal conductor 64 and the third outer electrode 43 are in contact with each other along an XY plane.

This increases the strength of the contact between the fourth terminal conductor 64 and the third outer electrode 43 and inhibits the thickness of the common mode choke coil 1A from increasing even when the fourth terminal conductor 64 is provided. The thickness of the fourth terminal conductor 64 is preferably equal to the thickness of the second spiral conductor 22. In this case, the thickness of the common mode choke coil 1A can be inhibited from increasing even when the fourth terminal conductor 64 is provided.

According to the above embodiment, the first terminal conductor and the second terminal conductor are provided. However, either only the first terminal conductor or the second terminal conductor may be provided. Although the third terminal conductor and the fourth terminal conductor are provided, either only the third terminal conductor or the fourth terminal conductor may be provided, or none of the third terminal conductor and the fourth terminal conductor may be provided.

Third Embodiment

Figure 6:
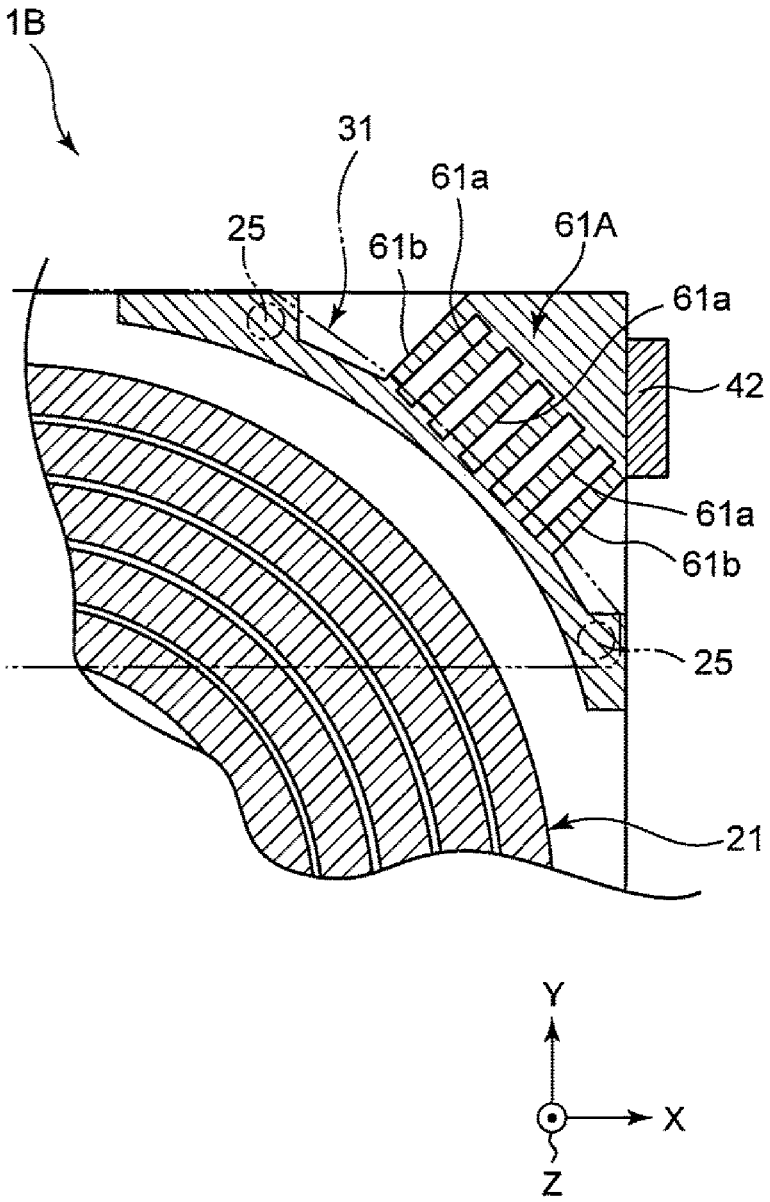
FIG. 6 schematically illustrates a common mode choke coil according to a third embodiment along an XY section.

FIG. 6 schematically illustrates a common mode choke coil according to a third embodiment along an XY section. The third embodiment differs from the second embodiment in including different terminal conductors. The different components will now be described. The other components are the same as those in the second embodiment and are designated by reference numbers like to those in the second embodiment, and a description thereof is omitted.

As illustrated in FIG. 6, a common mode choke coil 1B according to the third embodiment includes a first terminal conductor 61A having hollows 61*a* that extend therethrough in the thickness direction. The hollows 61*a* are arranged such that the longitudinal direction thereof extends toward the center of the first spiral conductor 21. The hollows 61*a* enable the flexibility of the common mode choke coil 1B to further increase. In particular, the flexibility in the direction intersecting the longitudinal direction of each hollow 61*a* further increases.

The hollows 61*a* are arranged in parallel to each other. The shape of each hollow 61*a* is substantially rectangular. The longitudinal direction of the hollow 61*a* is a direction between the X-direction and the Y-direction (for example, a direction at an angle of about 45 degrees from the X-direction). Consequently, the flexibility in both of the X-direction and the Y-direction, which intersect the longitudinal direction of the hollow 61*a*, further increases.

The shape of each hollow 61*a* is not limited to a substantially rectangular shape and may be a substantially ellipse shape or a substantially meandering S-shape. The longitudinal direction of the hollow 61*a* may extend in the direction intersecting the direction toward the center of the first spiral conductor 21. This enables a bending direction to be more freely changed.

The first terminal conductor 61A has notches 61*b* in regions other than a region in which the hollows 61*a* are formed and a region connected to the first extension conductor 31 with the corresponding columnar conductors 25 interposed therebetween. The notches 61*b* enable the flexibility of the common mode choke coil 1B to further increase.

Similarly, the second terminal conductor 62 has hollows. The hollows of the second terminal conductor 62 are arranged such that the longitudinal direction thereof extends toward the center of the second spiral conductor 22. This enables the flexibility of the common mode choke coil 1B to further increase. In particular, the flexibility in the direction intersecting the longitudinal direction of each hollow further increases. The second terminal conductor 62 may have notches.

According to the above embodiment, the first terminal conductor and the second terminal conductor have the hollows. However, either only the first terminal conductor or the second terminal conductor may have the hollows. The third and fourth terminal conductors may have hollows or notches.

Fourth Embodiment

Figure 7:
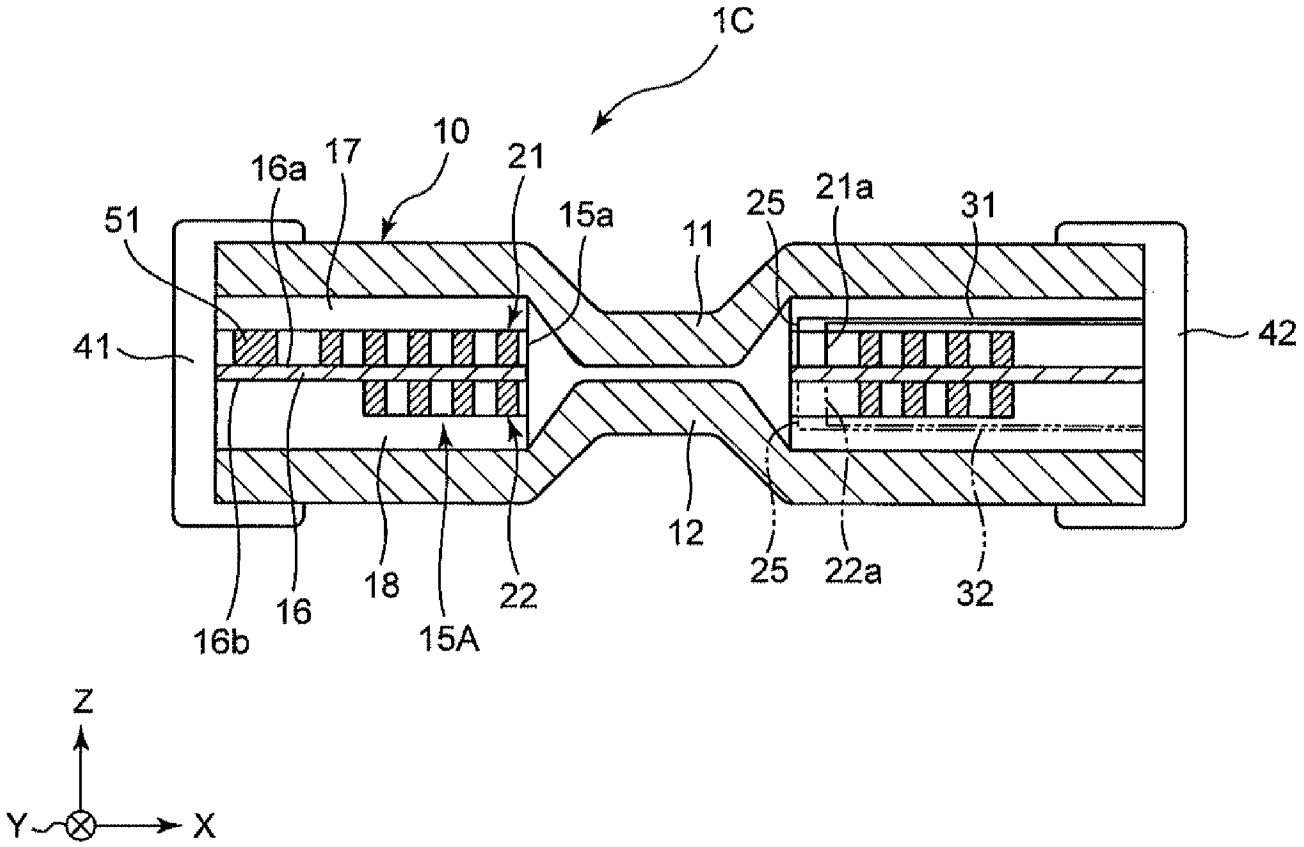
FIG. 7 is a perspective sectional view of a common mode choke coil according to a fourth embodiment taken along an XZ section.

FIG. 7 schematically illustrates a common mode choke coil according to a fourth embodiment along an XZ section. The fourth embodiment differs from the first embodiment in including a different insulator. The different component will now be described. The other components are the same as those in the first embodiment and are designated by reference numbers like to those in the first embodiment, and a description thereof is omitted.

As illustrated in FIG. 7, a common mode choke coil 1C according to the fourth embodiment includes an insulator 15A having a hollow 15*a* that extends through a central portion of the first spiral conductor 21 and a central portion of the second spiral conductor 22 in the thickness direction. For example, the shape of the hollow 15*a* is substantially circular along inner circumferential surfaces of the first spiral conductor 21 and the second spiral conductor 22. However, the shape is not limited thereto and may be a substantially ellipse shape or a substantially polygonal shape. The hollow 15*a* is formed by, for example, blasting or punching with a mold. The hollow 15*a* enables the flexibility of the common mode choke coil 1C to further increase.

The first extension conductor 31 and the second extension conductor 32 do not overlap the hollow 15*a* of the insulator 15A in a top view. Consequently, the first extension conductor 31 and the second extension conductor 32 do not overlap an inner, magnetic path on which magnetic flux is concentrated, and an eddy current loss, which is caused by blocking the magnetic flux, can be reduced. The hollow 15*a*, which greatly deforms due to bending, and the first and second extension conductors 31 and 32 do not overlap, and the first and second extension conductors 31 and 32 can be inhibited from being damaged due to bending.

The first magnetic material 11 and the second magnetic material 12 have no hollows. The first magnetic material 11 and the second magnetic material 12 face each other in the hollow 15*a* of the insulator 15A. The first magnetic material 11 and the second magnetic material 12 may be in contact with each other. Alternatively, the first magnetic material 11 and the second magnetic material 12 may be spaced from each other.

Fifth Embodiment

Figure 8:
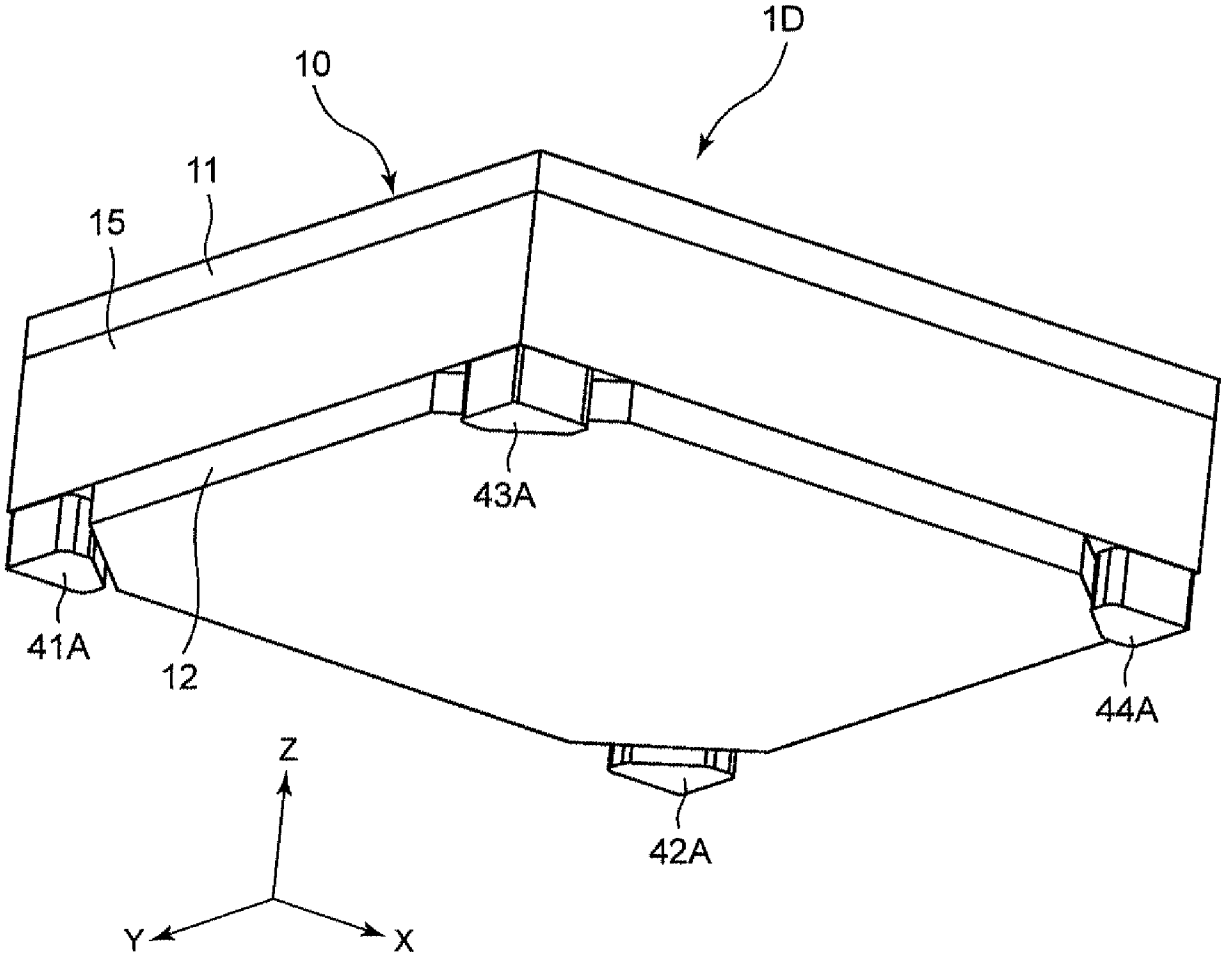
FIG. 8 is a perspective view of a common mode choke coil according to a fifth embodiment.
Figure 9A:
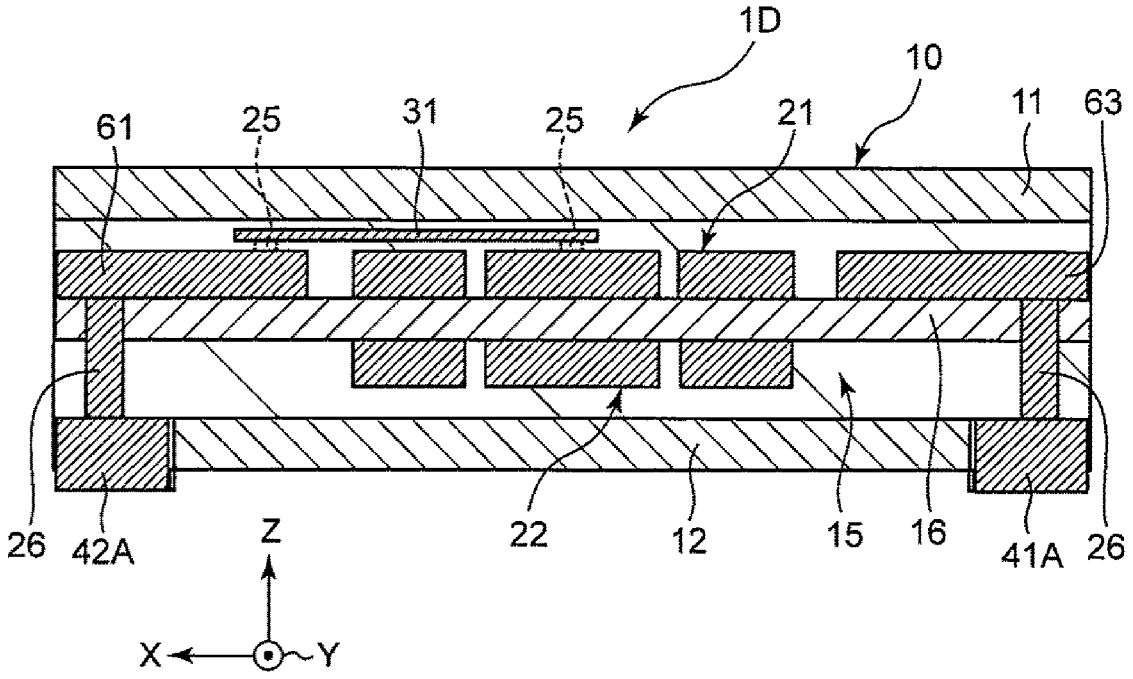
FIG. 9A schematically illustrates the common mode choke coil along an XZ section.
Figure 9B:
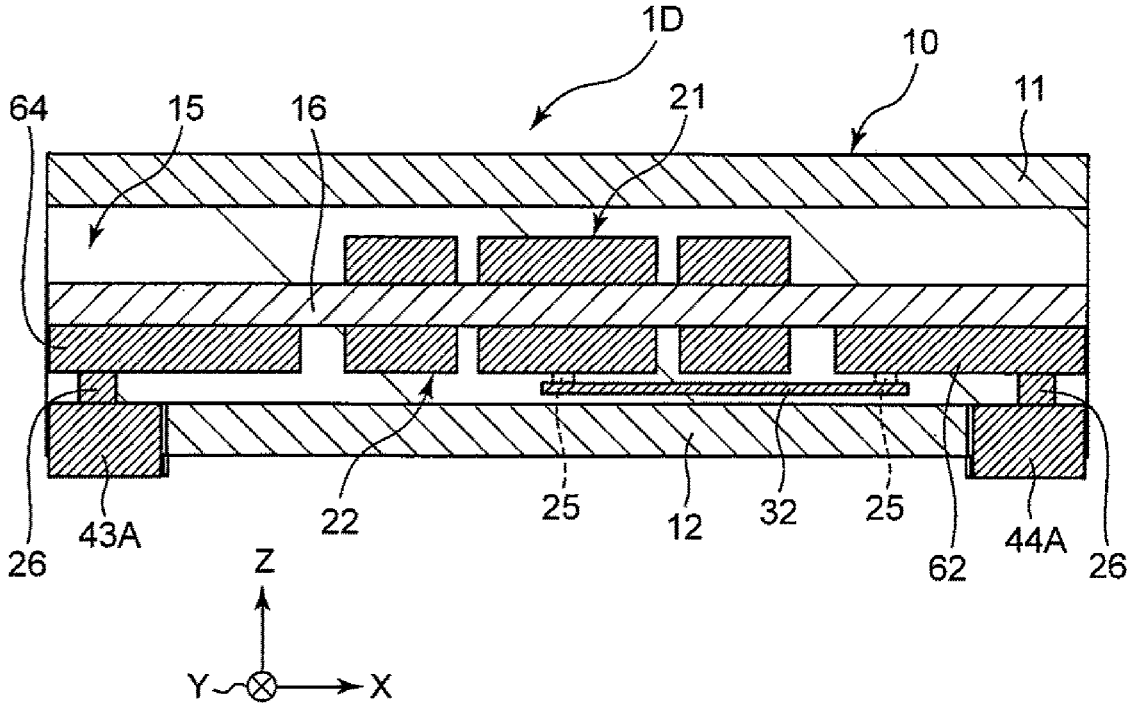
FIG. 9B schematically illustrates the common mode choke coil along an XZ section.

FIG. 8 is a perspective view of a common mode choke coil according to a fifth embodiment. FIG. 9A and FIG. 9B schematically illustrate the common mode choke coil in FIG. 8 along different XZ sections. The fifth embodiment differs from the second embodiment in including different outer electrodes. The different components will now be described. The other components are the same as those in the second embodiment and are designated by reference numbers like to those in the second embodiment, and a description thereof is omitted.

As illustrated in FIG. 8, FIG. 9A, and FIG. 9B, a common mode choke coil 1D according to the fifth embodiment includes first to fourth outer electrodes 41A to 44A that are formed on the lower surface (bottom surface) of the body 10. In the case where the first to fourth outer electrodes 41A to 44A are thus bottom electrodes, a tensile stress or a compressive stress caused by solder fillet on side surfaces of the electrodes when the mounted substrate is bent is eliminated. Accordingly, the common mode choke coil 1D has further increased flexibility.

The first terminal conductor 61 is connected to the second outer electrode 42A with a corresponding one of columnar conductors 26 that extend downward through the insulating substrate 16 interposed therebetween. Similarly, the third terminal conductor 63 is connected to the first outer electrode 41A with the corresponding columnar conductor 26 that extends downward through the insulating substrate 16 interposed therebetween.

A method of forming the first and second outer electrodes 41A and 42A and the columnar conductors 26 will now be described. Holes are drilled by laser drilling such that the holes reach the first and third terminal conductors 61 and 63 from the bottom surface of the body 10 to form cavities. The cavities are filled by electroless positive electrolyte copper plating from the first and third terminal conductors 61 and 63 to form the columnar conductors 26 that extend to the bottom surface of the body 10. Subsequently, the first and second outer electrodes 41A and 42A are disposed and connected to the columnar conductors 26.

The second terminal conductor 62 is connected to the fourth outer electrode 44A with the corresponding columnar conductor 26 that extends downward interposed therebetween. Similarly, the fourth terminal conductor 64 is connected to the third outer electrode 43A with the corresponding columnar conductor 26 that extends downward interposed therebetween.

A method of forming the third and fourth outer electrodes 43A and 44A and the columnar conductors 26 will now be described. Holes are drilled by laser drilling such that the holes reach the second and fourth terminal conductors 62 and 64 from the bottom surface of the body 10 to form cavities. The cavities are filled by electroless positive electrolyte copper plating from the second and fourth terminal conductors 62 and 64 to form the columnar conductors 26 that extend to the bottom surface of the body 10. Subsequently, the third and fourth outer electrodes 43A and 44A are disposed and connected to the columnar conductors 26.

The present disclosure is not limited to the embodiments described above. Modifications can be made without departing from the spirit of the present disclosure. For example, features according to the first to fifth embodiments may be combined in various ways. The number of the spiral conductors and the outer electrodes may be increased.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A common mode choke coil comprising:

a body;

a first spiral conductor and a second spiral conductor that face each other inside the body and that are wound in respective planes;

a first outer electrode, a second outer electrode, a third outer electrode, and a fourth outer electrode that are disposed on the body;

a first extension conductor that faces the first spiral conductor inside the body, that is on an opposite side of the first spiral conductor from the second spiral conductor, and that extends in a plane; and a second extension conductor that faces the second spiral conductor inside the body, that is on an opposite side of the second spiral conductor from the first spiral conductor, and that extends in a plane, wherein an outer circumferential end of the first spiral conductor is electrically connected to the first outer electrode, a first end portion of the first extension conductor is electrically connected to an inner circumferential end of the first spiral conductor, and a second end portion of the first extension conductor is electrically connected to the second outer electrode, an outer circumferential end of the second spiral conductor is electrically connected to the third outer electrode, a first end portion of the second extension conductor is electrically connected to an inner circumferential end of the second spiral conductor, and a second end portion of the second extension conductor is electrically connected to the fourth outer electrode, a thickness of the first extension conductor is equal to or less than (a thickness of the first spiral conductor)/(a winding number of the first spiral conductor), and a width of the first extension conductor is equal to or more than (a width of the first spiral conductor)×(the thickness of the first spiral conductor)/(the thickness of the first extension conductor), and a thickness of the second extension conductor is equal to or less than (a thickness of the second spiral conductor)/(a winding number of the second spiral conductor), and a width of the second extension conductor is equal to or more than (a width of the second spiral conductor)×(the thickness of the second spiral conductor)/(the thickness of the second extension conductor).

2. The common mode choke coil according to claim 1, further comprising:

a first terminal conductor that is connected between the first extension conductor and the second outer electrode inside the body and that extends in a plane; and a second terminal conductor that is connected between the second extension conductor and the fourth outer electrode inside the body and that extends in a plane, wherein the first terminal conductor and the first spiral conductor are arranged in the same plane, and the second terminal conductor and the second spiral conductor are arranged in the same plane.

3. The common mode choke coil according to claim 2, wherein a thickness of the first terminal conductor is equal to the thickness of the first spiral conductor, and a thickness of the second terminal conductor is equal to the thickness of the second spiral conductor.

4. The common mode choke coil according to claim 2, wherein each of the first terminal conductor and the second terminal conductor has a hollow that extends therethrough in a thickness direction.

5. The common mode choke coil according to claim 4, wherein the hollow of the first terminal conductor is located such that a longitudinal direction thereof extends toward a center of the first spiral conductor, and the hollow of the second terminal conductor is located such that a longitudinal direction thereof extends toward a center of the second spiral conductor.

6. The common mode choke coil according to claim 1, wherein the body includes an insulator that covers the first spiral conductor, the second spiral conductor, the first extension conductor, and the second extension conductor, and a first magnetic material and a second magnetic material that interpose the insulator therebetween in a thickness direction, the insulator has a hollow that extends through a central portion of the first spiral conductor and a central portion of the second spiral conductor in the thickness direction, and the first extension conductor and the second extension conductor do not overlap the hollow of the insulator in a top view.

7. The common mode choke coil according to claim 1, wherein the body includes an insulating substrate that contains glass cloth between the first spiral conductor and the second spiral conductor.

8. The common mode choke coil according to claim 3, wherein each of the first terminal conductor and the second terminal conductor has a hollow that extends therethrough in a thickness direction.

9. The common mode choke coil according to claim 8, wherein the hollow of the first terminal conductor is located such that a longitudinal direction thereof extends toward a center of the first spiral conductor, and the hollow of the second terminal conductor is located such that a longitudinal direction thereof extends toward a center of the second spiral conductor.

10. The common mode choke coil according to claim 2, wherein the body includes an insulator that covers the first spiral conductor, the second spiral conductor, the first extension conductor, and the second extension conductor, and a first magnetic material and a second magnetic material that interpose the insulator therebetween in a thickness direction, the insulator has a hollow that extends through a central portion of the first spiral conductor and a central portion of the second spiral conductor in the thickness direction, and the first extension conductor and the second extension conductor do not overlap the hollow of the insulator in a top view.

11. The common mode choke coil according to claim 3, wherein the body includes an insulator that covers the first spiral conductor, the second spiral conductor, the first extension conductor, and the second extension conductor, and a first magnetic material and a second magnetic material that interpose the insulator therebetween in a thickness direction, the insulator has a hollow that extends through a central portion of the first spiral conductor and a central portion of the second spiral conductor in the thickness direction, and the first extension conductor and the second extension conductor do not overlap the hollow of the insulator in a top view.

12. The common mode choke coil according to claim 4, wherein the body includes an insulator that covers the first spiral conductor, the second spiral conductor, the first extension conductor, and the second extension conductor, and a first magnetic material and a second magnetic material that interpose the insulator therebetween in a thickness direction, the insulator has a hollow that extends through a central portion of the first spiral conductor and a central portion of the second spiral conductor in the thickness direction, and the first extension conductor and the second extension conductor do not overlap the hollow of the insulator in a top view.

13. The common mode choke coil according to claim 5, wherein the body includes an insulator that covers the first spiral conductor, the second spiral conductor, the first extension conductor, and the second extension conductor, and a first magnetic material and a second magnetic material that interpose the insulator therebetween in a thickness direction, the insulator has a hollow that extends through a central portion of the first spiral conductor and a central portion of the second spiral conductor in the thickness direction, and the first extension conductor and the second extension conductor do not overlap the hollow of the insulator in a top view.

14. The common mode choke coil according to claim 8, wherein the body includes an insulator that covers the first spiral conductor, the second spiral conductor, the first extension conductor, and the second extension conductor, and a first magnetic material and a second magnetic material that interpose the insulator therebetween in a thickness direction, the insulator has a hollow that extends through a central portion of the first spiral conductor and a central portion of the second spiral conductor in the thickness direction, and the first extension conductor and the second extension conductor do not overlap the hollow of the insulator in a top view.

15. The common mode choke coil according to claim 2, wherein the body includes an insulating substrate that contains glass cloth between the first spiral conductor and the second spiral conductor.

16. The common mode choke coil according to claim 3, wherein the body includes an insulating substrate that contains glass cloth between the first spiral conductor and the second spiral conductor.

17. The common mode choke coil according to claim 4, wherein the body includes an insulating substrate that contains glass cloth between the first spiral conductor and the second spiral conductor.

18. The common mode choke coil according to claim 5, wherein the body includes an insulating substrate that contains glass cloth between the first spiral conductor and the second spiral conductor.

19. The common mode choke coil according to claim 6, wherein the body includes an insulating substrate that contains glass cloth between the first spiral conductor and the second spiral conductor.

20. The common mode choke coil according to claim 8, wherein the body includes an insulating substrate that contains glass cloth between the first spiral conductor and the second spiral conductor.

* * * * *